United States Patent [19]

Hamazaki et al.

[11] Patent Number: 4,652,233

[45] Date of Patent: Mar. 24, 1987

[54] GROUND FLARE STACK

[75] Inventors: Takeru Hamazaki, Yokohama, Japan; John F. Straitz, III, Meadowbrook, Pa.; Shintaro Yano, Tokyo, Japan

[73] Assignee: JGC Corporation, Tokyo, Japan

[21] Appl. No.: 895,572

[22] Filed: Aug. 12, 1986

Related U.S. Application Data

[63] Continuation of Ser. No. 751,997, Jul. 5, 1985, abandoned, which is a continuation of Ser. No. 649,149, Sep. 10, 1984, abandoned, which is a continuation of Ser. No. 338,106, Jan. 8, 1982, abandoned.

[30] Foreign Application Priority Data

Jan. 10, 1981 [JP] Japan ..... 56-2543

[51] Int. Cl.[4] ..... F23D 15/00

[52] U.S. Cl. ..... 431/202; 431/5

[58] Field of Search ..... 431/202, 4, 5

[56] References Cited

U.S. PATENT DOCUMENTS

| | | | |
|---|---|---|---|
| 3,490,466 | 1/1970 | Warnock | 431/202 X |
| 4,140,471 | 2/1979 | Straitz, III et al. | 431/202 X |
| 4,373,902 | 2/1983 | Reed et al. | 431/202 |

FOREIGN PATENT DOCUMENTS

| | | | |
|---|---|---|---|
| 592898 | 2/1960 | Canada | 431/202 |
| 2357804 | 5/1975 | Fed. Rep. of Germany | 431/5 |

*Primary Examiner*—Larry Jones

*Attorney, Agent, or Firm*—Armstrong, Nikaido, Marmelstein & Kubovcik

[57] ABSTRACT

Stable burning of waste combustible gases is assured even in a strong wind by using an improved ground flare stack. The stack, which is a cylinder containing burner nozzles therein, is provided with a fence surrounding the lower part of the stack, a roof extending outwardly from the stack above the fence, a louver at the opening between the fence and the roof for directing the air stream to the roof, and a circumferential baffle installed at the circumference of the bottom part of the stack. A preferable shape of the baffle is a truncated cone. Preferably, the stack has a fluidic diode, at the inside top thereof.

3 Claims, 17 Drawing Figures

GROUND FLARE STACK

This application is a continuation of Ser. No. 751,997, filed July 5, 1985 which in turn is a continuation of application Ser. No. 649,149 filed Sept. 10, 1984 which was a continuation of application Ser. No. 338,106 filed on Jan. 1, 1982, all abandoned.

BACKGROUND OF THE INVENTION

1. Field of the Invention

The present invention relates to an improved ground flare stack for burning waste combustible gases such as hydrocarbons.

2. State of the Art

In ground flare stacks, it is necessary to supply air required for burning waste gases stably to the burners in a cylindrical stack. The supply of air is made by non-forced draft, and therefore, influence by wind is inevitable. Under a substantially windless condition, flue gas from the combustion ascends inside the stack, and accordingly, air is introduced around the entire circumference of the lower part of the stack. Thus, air is supplied uniformly, and the combustion will continue stably. On the other hand, when it is windy, the stablity of the combustion is significantly affected causing flow turbulence, particularly because of the formation of eddies in the stack by the air stream flowing into the lower part of the stack from the windward side.

If an eddy occurs in the stack, particularly in the vicinity of the burner, the air supply to the burner will be uneven. Further, fresh air supply will be prevented. Thus, incomplete combustion occurs, and certain undesirable results are obtained such as the generation of black smoke and objectionable odor, or a luminous flame burning at the top of the stack.

In case of a very strong wind, air flows even into the top of the stack obstructing air flow into the bottom of the stack. As a result, normal combustion can not be achieved. In an extreme case, flame may shoot out from the air inlet and the lower part of the stack to create a very dangerous situation.

Seeking a way to weaken the influence of wind on the operation of the ground flare stack mentioned above, we made a survey from various view points. We considered the known countermeasures for a ground flare stack which comprises a stack, a cylindrical fence concentrically surrounding the air inlet at the bottom of the stack, a roof extending outward from the stack above the fence, and a louver at the opening between the fence and the roof. The fence will intercept wind so that the wind may not flow into the stack with velocity head, the roof prevents wind from blowing down inside of the fence so as to stabilize the air stream, and the louver straightens the air stream flowing in. It was experienced, however, that the the countermeasures were still insufficient to completely weaken the influence of a very strong wind, and the expected stable burning of the waste gas was difficult to maintain.

Against the wind blowing into the stack from the top thereof, there was invented and proposed (U.S. Pat. No. 3,730,673) a so-called fluidic diode, or truncated conical-shaped baffle which permits upward flow of flue gas discharge, but resists to intrusion of air from the top, at the inside top of the stack. The fluidic diode is useful to some extent. However, the combination of the fluidic diode with the above mentioned roof, fence and louver failed to give a completely satisfactory ground flare stack.

Our further survey revealed the fact that, while the air stream once intercepted by the fence intrudes inside the stack, eddies occur between the fence and the stack below the stack and along the inner wall of the stack. The experimental result showed that occurrence of the eddies could not be prevented even by using the roof and the louver, and that, in the strongest wind, a portion of the air from the windward side which passed between the fence and the stack to reach the bottom of the stack flows under the bottom of the stack and away to the leeward side.

SUMMARY OF THE INVENTION

The object of the present invention is to provide an improved ground flare stack which can be operated even in an usually conceivable strongest wind to maintain a stable burning of the waste gas.

This object can be achieved by the present invention described below with reference to the attached drawings.

DRAWINGS

FIG. 1 is a cross sectional view of a ground flare stack according to the present invention.

FIG. 2 and FIG. 3 explain the mechanism of effect of the present invention; the former being a vertical section of the essential parts, and the latter being an horizontal section.

Figure 1:
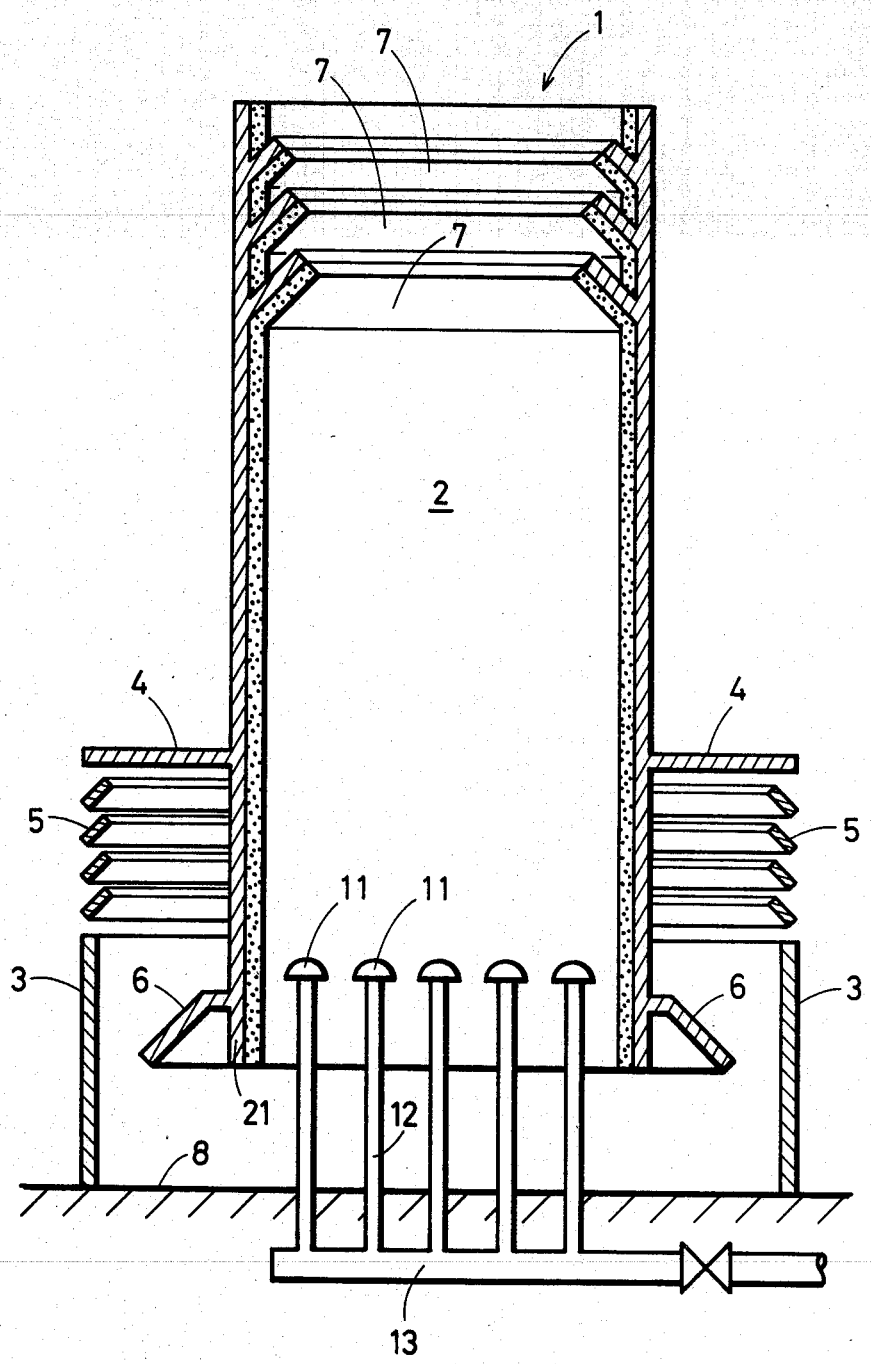
Figure 6A:
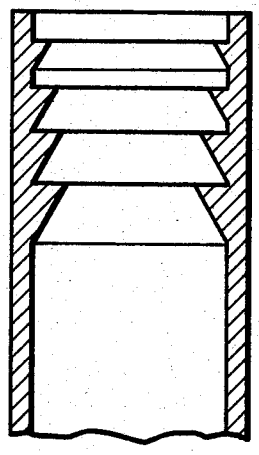
Figure 6B:
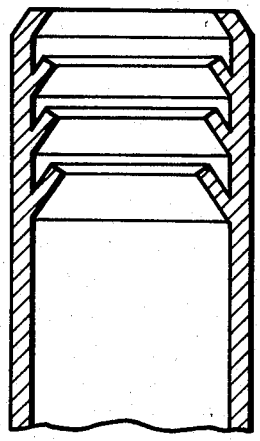
Figure 6C:
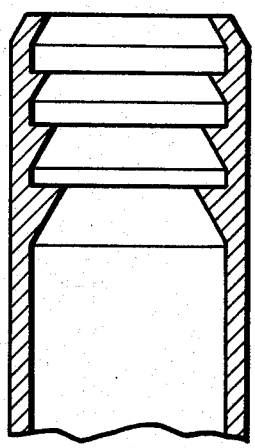

FIGS. 6A, 6B and 6C shown cross sections of the fluidic diode which can be employed in the present invention other than that shown in FIG. 1.

Figure 7A:
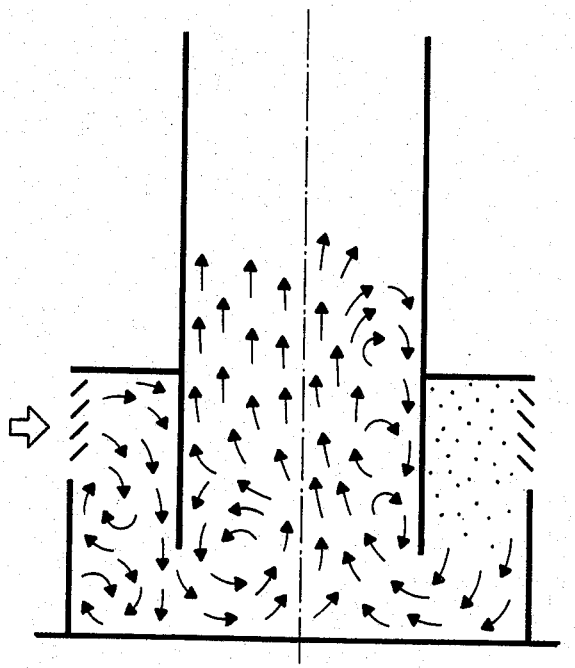
FIG. 7A PRIOR ART
Figure 7B:
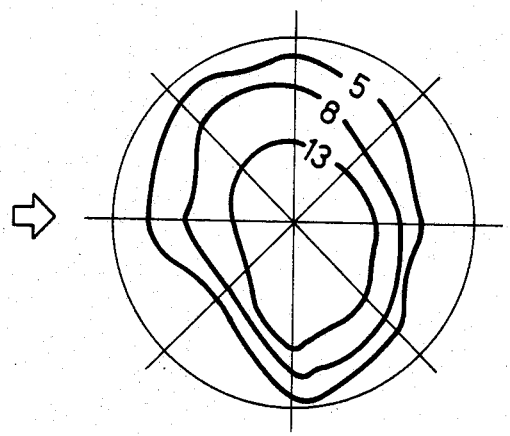
FIG. 7B PRIOR ART
Figure 7C:
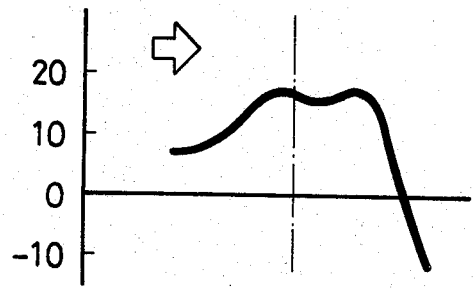
FIG. 7C PRIOR ART

FIGS. 7A to 7C illustrate the extent of stabilizing air stream in a ground flare stack of the best embodiment according to the conventional technology. FIG. 7A shows the flow patter; 7B shows horizontal fluid velocity profile; and 7C shows vertical velocity profile in the wind direction centerline plane of the stack.

Figure 8A:
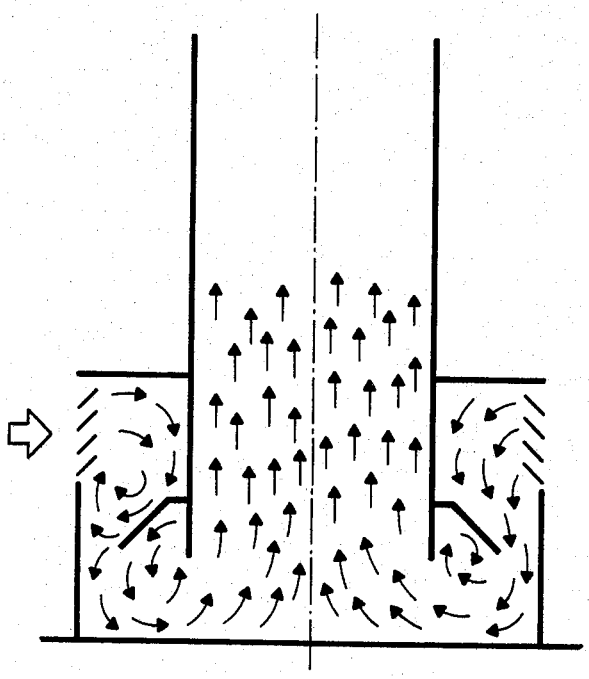
Figure 8B:
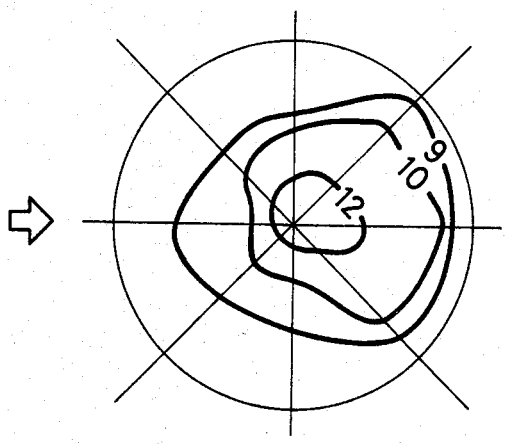
Figure 8C:
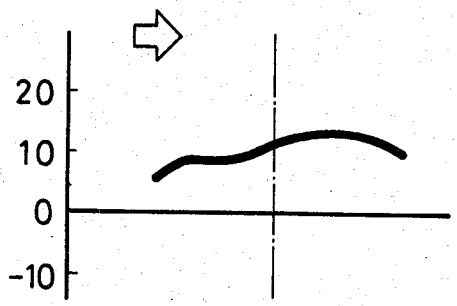

FIGS. 8A to 8C illustrate the effect of stabilizing air stream according to the present invention. FIGS. 8A, 8B and 8C are diagrams corresponding to FIGS. 7A, 7B and 7C, respectively.

PREFERRED EMBODIMENTS OF THE INVENTION

The presently proposed ground flare stack comprises, as shown in FIG. 1, a cylindrical stack 2 containing burner nozzles 11 for combustible gas therein and which is open at the top for flue gas discharge and open at the bottom for air intake to support the combustion, a fence 3 concentrically surrounding lower part of the stack, a roof 4 extending radially outward from the stack above the fence, and a louver 5 installed at the opening between the fence and the roof for directing an incoming air stream towards the roof. The invention is characterized in that the stack 2 is provided with a circumferential baffle 6 at the bottom part thereof and protruding outwardly therefrom.

The waste gas to be disposed of by burning is fed from the flare gas header 13 to the burner 11 through a stand pipe 12. Needless to say, the stack 2 is supported by stays (not shown in the Figure).

In the present ground flare stack, the air stream around the burner nozzles is not disturbed even by a strong wind because of the baffle 6 which is the characteristic feature of this invention. The mechanism of this stabilization will be illustrated below.

Figure 2:
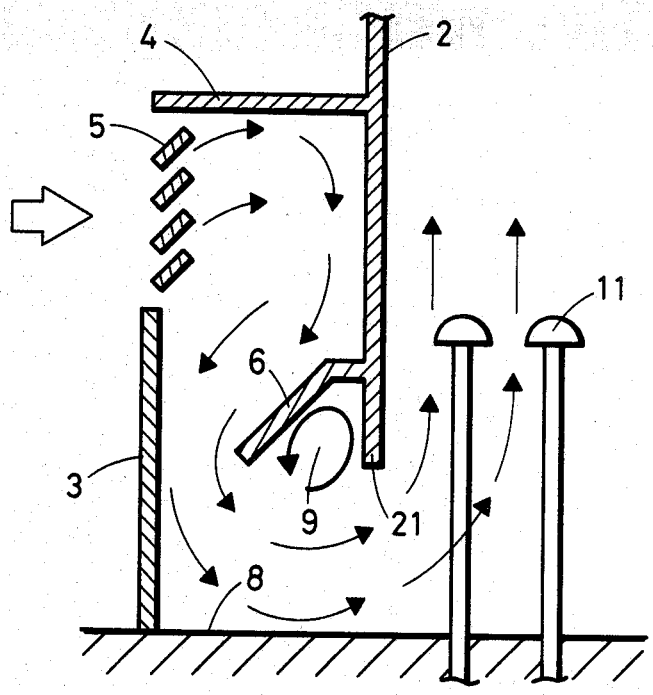

As shown in FIG. 2, the air stream is directed by the louver 5 so as to dash against the lower surface of the roof 4, and turns along the roof and the outer surface of the stack 2 in the direction shown by the arrows to flow downward between the fence and the stack. Then, the air stream is forced to change its direction outwardly by the baffle 6, and proceeds along the inner surface of the fence 3 and ground surface 8 to take a long way around the lower edge 21 of the stack for final upward flow inside the stack. In the dead space 9 formed by the baffle and the bottom part of the stack an eddy occurs as shown by a bold arrow. This eddy remains stable in a wide range of air stream velocities and promotes smooth detour of the air stream coming down inside the fence into the stack.

Figure 3:
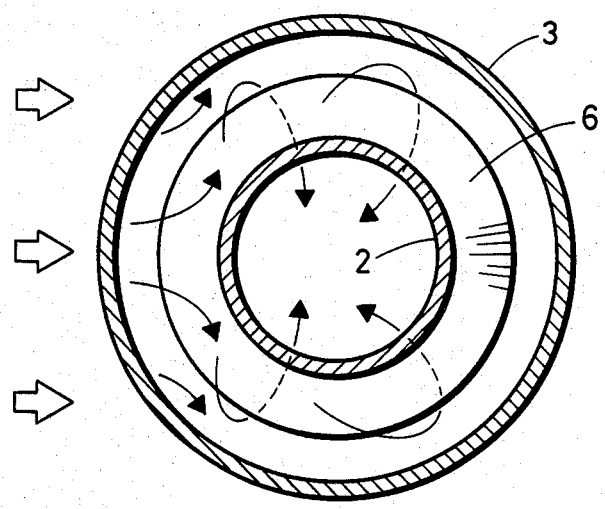
Figures 4A, 4B, 4C, 4D:
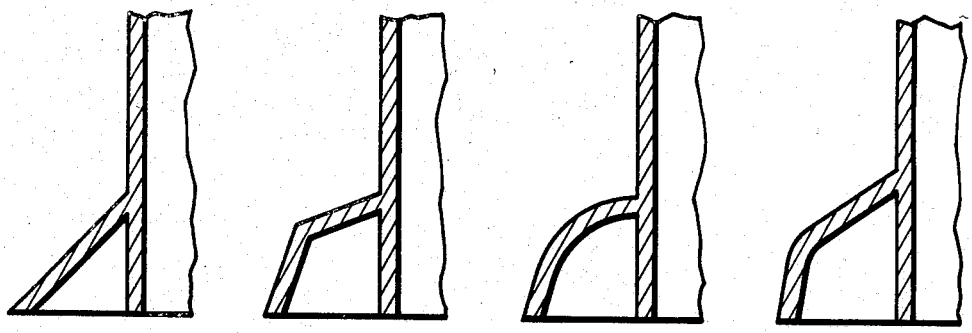
FIGS. 4A, 4B, 4C and 4D show cross section of the baffle of the present invention.

Because the flow area between the fence and the stack is reduced by the baffle 6, a decreased amount of air directly flows into the stack from windward side in comparison with the case of a stack having no baffle, and an increased amount of air flows into the stack via roundabout ways in every direction. The flow lines are shown in FIG. 3. Also, the baffle effectively prevents air which intruded from the windward under the bottom of stack from bypassing to the leeward.

The embodiment of the baffle with the profile shown in the Figures, the truncated conical shape, is advantageous because of easy manufacturing. This is the only example, and the shape of the baffle may be chosen from varieties of shapes of cones, pyramids and the like having the same effect. FIGS. 4A–D shows some other embodiments of the baffle.

The shape of the stack and the fence is, of course, not limited to the cylinder shown in FIG. 3, but may be polygonal.

Figure 5:
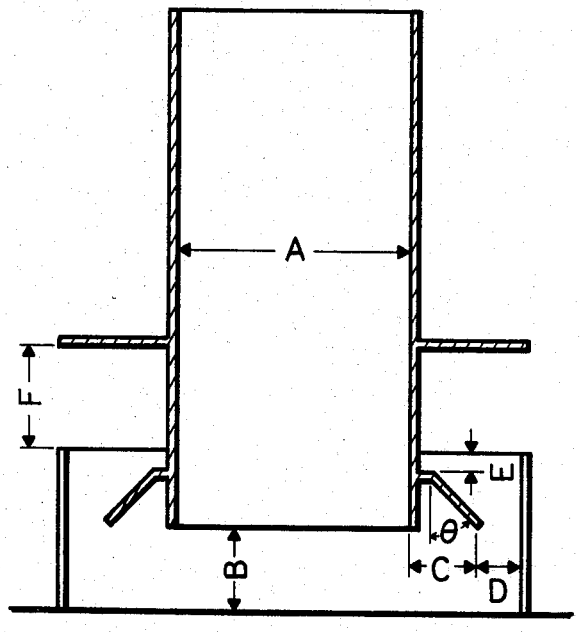
FIG. 5 is an explanatory figure to give standards for designing the ground flare stack in accordance with this invention.

In order to facilitate designing the ground flare stack according to the present invention, we disclose the dimensional standards concluded from our experimental results concerning the case using a truncated conical baffle with reference to FIG. 5.

(A) The lower edge of the baffle and the bottom edge of the stack are preferably in the same level, or the former should be below the latter. Satisfaction of this condition enables stable development of the above mentioned eddy in the dead space, and further, is useful for preventing reverse shooting out of the flue gas or flame from the bottom of the stack even in an extremely strong wind.

(B) The inclination of the baffle to the wall of the stack "$\theta$" may be $30° \leqq \theta < 90°$. Preferable range is $30° < \theta < 60°$.

(C) The distance from the ground surface to the bottom edge of the stack "B" should be chosen in connection with the diameter of the stack "A" from a range wherein the free flow area in those parts, "b" and "a", respectively, satisfy the following relation:

$$1.2a \leqq b \leqq 2a$$

wherein, $a = \frac{1}{4}\pi A^2$, and $b = \pi AB$ (D) The limit to which the baffle extends "C" horizontally, or the width of the flow area inside the fence "D" is determined in accordance with the following relations:

$$0.5B \leqq C \leqq B,$$

and $$0.5b \leqq d \leqq 0.8b$$

wherein, $d = \pi(A + 2C + D)D$ (E) The "E", or the level difference between the upper edge of the fence and the root of the baffle is preferably large. Too large a difference, however, is meaningless, and therefore, it should be determined in view of the construction cost.

(F) Suitable free area of the louver "f" is in the range:

$$0.9a \leqq f \leqq 2a$$

wherein, $f = \pi(A + 2C + 2D)F$.

As shown in FIG. 1, the ground flare stack of the present invention is preferably equipped with one or more of the above mentioned fluidic diodes inside top of the stack 2. Use of the fluidic diode strengthens the effect of the baffle 6 installed at the bottom of the stack to stabilize the air stream around the burner nozzles 11. Consequently, complete combustion of the waste gas is assured.

The air stream which may intrude from the top along the inner wall of the stack is obstructed in the space formed by the truncated conical-shaped fluidic diode and the inner wall of the stack and, forming a small eddy therein, is turned back toward the top. The air which may flow down from the top in the central opening of the stack is blown back due to concerted action of the ascending stream of the flue gas and the above noted turning back of the intruding air stream.

The effect of the fluidic diode will be high when two or more are used. Use of more than four diodes, however, has little significance. In case where plural fluidic diodes are used, it is desirable, as shown in FIG. 1 (where three diodes are used), to provide the diodes in an arrangement wherein the central openings of the diodes are concentrical with the stack and the flow areas determined by the diodes increase from the lower part to the top of the stack.

In ground flare stacks, contrary to elevated flare, stacks the temperature of the discharge gas is high, and hence, it is desirable to provide a lining made of a refractory material at least on the inner surface (facing to the bottom) of some (particularly those located at lower parts) or all of the fluidic diodes. The fluidic diode may comprise a refractory material as a whole.

Profile of the fluidic diode is not limited to that shown in FIG. 1, and those with different profiles can be used. FIGS. 6A, 6B and 6C show the other embodiments.

The present ground flare stack was invented on the basis of the idea of controlling air stream by positively forming a stable eddy, which previously has been a cause of disturbance of the air stream in the stack, with the baffle. The change of the undesirable cause to a favorable factor proved the successful results. Particularly, the preferred embodiments in which the fluid diode is used in combination with the baffle, unless an unusual high wind occurs, always achieve an entirely stable complete combustion of the waste gas.

The effect will be illustrated with reference to the experimental data below.

Firstly, we constructed the ground flare stack having the relative dimensions given in FIG. 7A to comprehend all the known arrangements for stabilization. The apparatus thus prepared was subjected to simulation tests with flowing water. FIG. 7A shows flow patterns in the stack, and 7B shows fluid velocity profile in a horizontal plane. The curves in FIG. 7B are contour lines of the velocity, which is indicated with the figures. FIG. 7C records a profile of fluid velocity in the vertical direction in a plane parallel with the direction of the wind and passing through the centerline of the stack.

Then, we constructed the ground flare stack having the relative dimensions given in FIG. 8A, or the apparatus of FIG. 7A to which the truncated conical-shaped baffle as shown in FIG. 1 is added.

Results of the same simulation tests on the apparatus according to the present invention are shown in FIGS. 8A to 8C. Comparison of these Figures with corresponding FIGS. 7A to 7C clearly show the remarkable improvements.

We claim:

1. A ground flare stack essentially comprising a stack containing burner nozzles for combustible gas therein, open at the top for flue gas discharge and open at the bottom for air intake to support the combustion, a fence concentricaly surrounding lower part of the stack, a roof extending radialy outwardly from the stack above the fence, and a louver installed at the opening between the fence and the roof for directing an incoming air stream towards the roof, characterized in that the stack is provided with a circumferential baffle at the bottom part of the stack protruding radially outwardly and downwardly therefrom at a position above the bottom part thereof.

2. A ground flare stack of claim 1, wherein the baffle is in a truncated conical-shape.

3. A ground flare stack of claim 1, wherein the stack is provided with at least one fluidic diode inside and at the top part thereof for permitting discharge of the flue gas and obstructing downward flow of air from the top.

* * * * *